US009925635B2

(12) United States Patent
Shibata

(10) Patent No.: US 9,925,635 B2
(45) Date of Patent: Mar. 27, 2018

(54) EYEGLASS LENS PROCESSING APPARATUS

(75) Inventor: Ryoji Shibata, Aichi (JP)

(73) Assignee: NIDEK CO., LTD., Aichi (JP)

( * ) Notice: Subject to any disclaimer, the term of this patent is extended or adjusted under 35 U.S.C. 154(b) by 518 days.

(21) Appl. No.: 13/248,640

(22) Filed: Sep. 29, 2011

(65) Prior Publication Data

US 2012/0083186 A1 Apr. 5, 2012

(30) Foreign Application Priority Data

Sep. 30, 2010 (JP) ..... 2010-222883

(51) Int. Cl.

| | |
|---|---|
| ***B24B 9/14*** | (2006.01) |
| ***B24B 49/02*** | (2006.01) |
| ***B24B 51/00*** | (2006.01) |
| ***B24B 47/22*** | (2006.01) |

(52) U.S. Cl.

CPC ..... *B24B 9/148* (2013.01); *B24B 9/14* (2013.01); *B24B 9/144* (2013.01); *B24B 47/22* (2013.01); *B24B 49/02* (2013.01); *B24B 51/00* (2013.01)

(58) Field of Classification Search

CPC .. B24B 1/00; B24B 9/14; B24B 9/144; B24B 9/148; B24B 47/22; B24B 47/225; B24B 49/00; B24B 49/02; B24B 49/16; B24B 51/00

USPC ..... 451/5, 10, 11, 43, 69, 70, 242, 246, 256

See application file for complete search history.

(56) References Cited

U.S. PATENT DOCUMENTS

| | | | | |
|---|---|---|---|---|
| 5,775,973 | A | 7/1998 | Watanabe | |
| 6,220,929 | B1 * | 4/2001 | Mizuno | 451/5 |
| 6,859,336 | B1 * | 2/2005 | Wada et al. | 359/819 |
| 6,881,125 | B1 | 4/2005 | Wada | |
| 7,617,579 | B2 | 11/2009 | Natsume | |
| 8,235,770 | B2 * | 8/2012 | Obayashi | 451/43 |
| 8,241,091 | B2 * | 8/2012 | Takeichi | 451/5 |
| 8,260,451 | B2 * | 9/2012 | Takeichi | 700/164 |

(Continued)

FOREIGN PATENT DOCUMENTS

| | | | |
|---|---|---|---|
| CN | 1449889 | A | 10/2003 |
| CN | 1764517 | A | 4/2006 |

(Continued)

OTHER PUBLICATIONS

Office Action dated Jan. 28, 2014 by the Japanese Patent Office in corresponding Japanese Application No. 2010-222883.

(Continued)

*Primary Examiner* — Eileen Morgan

(74) *Attorney, Agent, or Firm* — Sughrue Mion, PLLC

(57) ABSTRACT

In an eyeglass lens processing apparatus, if a material selector selects a thermoplastic material for the lens, a control unit performs a first step and then a second step. In the first step, the control unit controls a lens rotating unit to position a lens in a plurality of lens rotation angles and controls an axis-to-axis distance changing unit to cause a roughing tool to cut into the lens up to a roughing path for each of the plurality of lens rotation angles, the lens being not rotated by the lens rotating unit when the roughing tool is cutting into the lens up to the roughing path. In the second step, the control unit controls the lens rotating unit and the axis-to-axis distance changing unit to rough the lens based on the roughing path while the lens rotating unit rotates the lens.

20 Claims, 9 Drawing Sheets

(56) References Cited

U.S. PATENT DOCUMENTS

| | | | | |
|---|---|---|---|---|
| 2002/0086613 | A1 | 7/2002 | Hatano | |
| 2003/0087583 | A1 | 5/2003 | Shibata | |
| 2003/0087584 | A1 | 5/2003 | Shibata | |
| 2004/0048555 | A1 | 3/2004 | Jinbo | |
| 2004/0192170 | A1 | 9/2004 | Mizun | |
| 2005/0107002 | A1* | 5/2005 | Gottschald et al. | 451/8 |
| 2006/0217036 | A1 | 9/2006 | Meunier et al. | |
| 2007/0183056 | A1 | 8/2007 | Conte et al. | |
| 2008/0117382 | A1 | 5/2008 | Lacan et al. | |
| 2008/0248720 | A1 | 10/2008 | Shibata | |
| 2008/0248722 | A1* | 10/2008 | Takeichi | 451/5 |
| 2009/0176442 | A1* | 7/2009 | Takeichi et al. | 451/8 |
| 2010/0197198 | A1* | 8/2010 | Takeichi | 451/5 |
| 2010/0248590 | A1* | 9/2010 | Shibata et al. | 451/5 |
| 2010/0311310 | A1* | 12/2010 | Takeichi | 451/5 |

FOREIGN PATENT DOCUMENTS

| | | | |
|---|---|---|---|
| CN | 101274415 | A | 10/2008 |
| EP | 0 196 144 | A2 | 10/1986 |
| EP | 0802020 | A1 | 10/1997 |
| EP | 1445065 | A1 | 8/2004 |
| JP | S62-9858 | A | 1/1987 |
| JP | 62-181864 | A | 8/1987 |
| JP | 2000-210854 | A | 8/2000 |
| JP | 2000-317789 | A | 11/2000 |
| JP | 2002126982 | A | 5/2002 |
| JP | 2002-361545 | A | 12/2002 |
| JP | 2003145328 | A | 5/2003 |
| JP | 2003145400 | A | 5/2003 |
| JP | 2003300136 | A | 10/2003 |
| JP | 2003-340698 | A | 12/2003 |
| JP | 2006-123073 | A | 5/2006 |
| JP | 2006-319292 | A | 11/2006 |
| JP | 2006-334701 | A | 12/2006 |
| JP | 2007-506998 | A | 3/2007 |
| JP | 2009-519839 | A | 5/2009 |

OTHER PUBLICATIONS

Office Action, dated Apr. 22, 2014, issued by the Japanese Patent Office in counterpart Japanese Patent Application No. 2010-222883.

Search Report dated Oct. 2, 2014, issued by the European Patent Office in counterpart European Application No. 11007888.8.

Office Action dated Feb. 2, 2015, issued by the State Intellectual Property Office of the People's Republic of China in counterpart Chinese Application No. 201110306919.X.

Office Action dated Apr. 4, 2016 in corresponding Japanese Patent Application No. 2014-14234.

Translation of an Office Action dated Apr. 4, 2016 by the Japanese Patent Office in counterpart Japanese Application No. 2010-222883.

* cited by examiner

EYEGLASS LENS PROCESSING APPARATUS

BACKGROUND

The present invention relates to an eyeglass lens processing apparatus that processes a periphery of an eyeglass lens.

In an apparatus that processes the periphery of an eyeglass lens, the eyeglass lens is held by a pair of lens chuck shafts, the lens is rotated by the rotation of the lens chuck shafts, and a roughing tool such as a roughing grindstone is pressed on the lens, whereby the periphery of the lens is roughed. A cup which is a processing jig is fixed onto the surface of the eyeglass lens, and the lens is held by the pair of lens chuck shafts via the cup.

In recent years, a water repellent lens obtained by coating the lens surface with a water repellent material to which water, oil, or the like is not easily attached has become widely used. The surface of the water repellent lens is slippery. Therefore, if the same processing control as in the related art, which is applied to a lens that is not coated with the water repellent material, is applied to the water repellent lens, there is a problem in that so-called "axial deviation" easily occurs in which the rotation angle of the lens deviates with respect to the rotation angle of the lens chuck shaft since the fixed cup slips.

As a method of reducing the "axial deviation", a technique of detecting load torque applied to the lens chuck shaft and reducing the rotation speed of the lens so as to make the load torque fall within a predetermined value has been proposed (see US2004-192170A1). In addition, a technique has been proposed of rotating the lens at a certain speed and changing the axis-to-axis distance between the lens chuck shafts and the rotation shaft of a processing tool so as to make the cutting amount of the roughing grindstone become approximately constant for one revolution of the lens (see JP2006-334701A). Moreover, as an improved technique disclosed in JP2006-334701A, a technique has been proposed of setting a processing volume per unit time to prevent the occurrence of the "axial deviation" and controlling the axis-to-axis distance by determining the cutting amount per rotation angle of the lens so as to make the processing volume per unit time become constant (see US2010-197198A1).

The control of the rotation direction of the lens in roughing includes a down-cut method in which the rotation direction of the roughing grindstone is opposite to that of the lens, and an up-cut method in which the rotation direction of the roughing grindstone is the same as that of the lens. In the up-cut method, a force pulling the lens to the roughing grindstone side increases, so the "axial deviation" occurs frequently. In the down-cut method, the force pulling the lens to the roughing grindstone is weaker compared to the up-cut method. Accordingly, when the material of the lens is a normal plastic, the down-cut method is used. When the material of the lens is a thermoplastic material (which is a polycarbonate representatively, and Trivex, acryl, and the like are also included in the material), grinding water is not used in roughing (see U.S. Pat. No. 7,617,579B1). As a result, if the down-cut method is used, processing waste discharged in the rotation direction of the roughing grindstone tends to become sticky due to influence from the heat, and the processing waste melted by the heat attaches to the periphery of the lens that has undergone the roughing, which influences processing accuracy of subsequent finishing. In the up-cut method, the processing waste discharged in the rotation direction of the roughing grindstone is discharged to the side of a portion that has not been processed in the roughing. Therefore, it is difficult for the molten processing waste to attach to the periphery of the lens. For this reason, in the case of a lens of a thermoplastic material, the up-cut method is used.

SUMMARY

A water repellent coating is also applied to the lens formed of the thermoplastic material. If processing of thermoplastic lens treated with the water repellent coating is attempted with the up-cut method, the problem of the "axial deviation" cannot be sufficiently suppressed even if the processing control in US2004-192170A1, JP2006-334701A and US2010-197198A1 is used. Furthermore, if an attempt to prevent this problem is made, there is a problem in that the processing time is lengthened greatly.

The invention has been made to solve the above problems, and a technical object thereof is to provide an eyeglass lens processing apparatus which can efficiently perform processing by effectively suppressing the "axial deviation" of the lens (especially for the thermoplastic lens).

The aspect of the invention provides the following arrangements:

(1) An eyeglass lens processing apparatus comprising:

a lens rotating unit including a lens chuck shaft for holding an eyeglass lens and a motor for rotating the lens chuck shaft;

a processing tool rotating unit including a roughing tool for roughing a periphery of the lens, a processing tool rotating shaft to which the roughing tool is attached, and a motor for rotating the processing tool rotating shaft;

an axis-to-axis distance changing unit including a motor for changing an axis-to-axis distance between the lens chuck shaft and the processing tool rotating shaft;

a control unit configured to obtain roughing path based on a target lens shaft, and control the lens rotating unit and the axis-to-axis distance changing unit based on the obtained roughing path to rough the periphery of the lens by the roughing tool, wherein the control unit performs a first step and then a second step, wherein in the first step, the control unit controls the lens rotating unit to position the lens in a plurality of lens rotation angles and controls the axis-to-axis distance changing unit to cause the roughing tool to cut into the lens up to the roughing path for each of the plurality of lens rotation angles, the lens being not rotated by the lens rotating unit when the roughing tool is cutting into the lens up to the roughing path, and wherein in the second step, the control unit controls the lens rotating unit and the axis-to-axis distance changing unit to rough the lens based on the roughing path while the lens rotating unit rotates the lens.

(2) The eyeglass lens processing apparatus according to (1), wherein in the first step, after the roughing tool cuts into the lens up to the roughing path while not rotating the lens, the control unit controls the axis-to-axis distance changing unit to separate the lens from the roughing tool, controls the lens rotating unit to rotate the lens by a predetermined angle, controls the axis-to-axis distance changing unit to cause the roughing tool to cut into the lens up to the roughing path again while not rotating the lens, and repeats these processes in the plurality of lens rotation angle directions until the lens rotates once under these processes.

(3) The eyeglass lens processing apparatus according to (2), wherein the predetermined angle is set within a range from 30 degrees to 80 degrees.

(4) The eyeglass lens processing apparatus according to (3), wherein the plurality of lens rotation angles are angles obtained by dividing one rotation of the angle by 5 to 12.

(5) The eyeglass lens processing apparatus according to (3), wherein the plurality of rotating angles are stored in a memory as predetermined values.

(6) The eyeglass lens processing apparatus according to (3), wherein the control unit sets the plurality of rotating angles based on a diameter of the roughing tool, the roughing path or a target lens shape, and a diameter of the unprocessed lens.

(7) The eyeglass lens processing apparatus according to (6), wherein the control unit sets the plurality of rotating angles so that the entire periphery of the lens is processed by the roughing tool at the first step.

(8) The eyeglass lens processing apparatus according to (6), wherein the control unit sets the plurality of rotating angles so that a distance between a chuck center of the lens chuck shaft and a roughing region where the roughing tool roughs the lens in the first step is equal to or less than a predetermined distance which is smaller than a radius of the lens and at which an axial deviation between the lens and the lens chuck shaft does not occur at the second step.

(9) The eyeglass lens processing apparatus according to (6), wherein the plurality of lens rotation angles are angles obtained by dividing one rotation of the angle by 5 to 12, and an interval of the adjacent angles are within a range between 30 degrees and 80 degrees.

10. The eyeglass lens processing apparatus according to (1) further comprising a material selector configured to select material of the lens, wherein if the material selector selects a thermoplastic material for the lens, the control unit performs the first step and then the second step, wherein in the second step of roughing, the control units controls the lens rotating unit to rotate the lens in the same direction as the rotation direction of the roughing tool.

(11) The eyeglass lens processing apparatus according to (10), wherein if the material selector selects a lens of thermoset material, the control unit performs the second step, in the second step, the control unit controls the lens rotating unit to rotate the lens in a direction opposite to a rotating direction of the roughing tool.

(12) The eyeglass lens processing apparatus according to (1), wherein the control unit controls the axis-to-axis distance changing unit so that a cutting-in speed of the roughing tool at the first step is set to equal to or less than a predetermined allowable value.

(13) The eyeglass lens processing apparatus according to (1) further comprising a processing mode selector configured to select a first mode in which a surface of the lens is slippery and a second mode in which the surface of the lens is normal, wherein the control unit controls the axis-to-axis distance changing unit so that the cutting-in speed of the roughing tool at the first step in the second mode is faster than that of the first mode, and controls the lens rotating unit so that the rotating speed of the lens at the second step in the second mode is higher than that of the first mode.

According to the invention, it is possible to efficiently perform processing and suppress the "axial deviation" of the thermoplastic lens.

DESCRIPTION OF EXEMPLARY EMBODIMENTS

Figure 1:
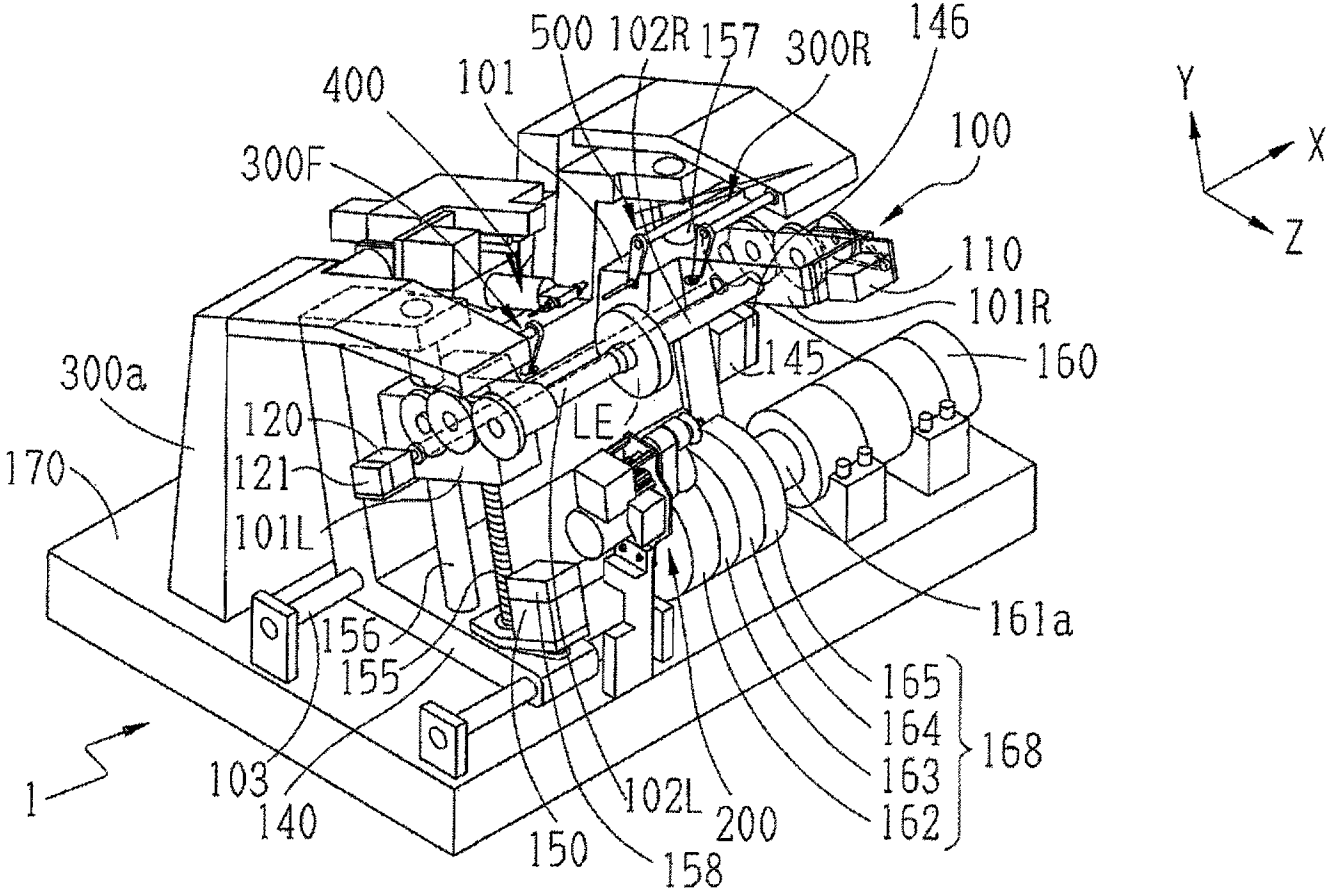
FIG. 1 is a schematic configuration view of a processing portion of an eyeglass lens processing apparatus.

Exemplary embodiments of the invention will be described with reference to drawings. FIG. 1 is a schematic configuration view of an eyeglass lens processing apparatus.

A carriage 101 that rotatably holds a pair of lens chuck shafts 102L and 120R is mounted on a base 170 of a processing apparatus 1. The periphery of an eyeglass lens LE interposed between the chuck shafts 120L and 102R is processed by being pressed on each grindstone of a grindstone group 168 as a processing tool which is coaxially provided on a spindle (rotation shaft of the processing tool) 161*a*.

The grindstone group 168 includes a roughing grindstone 162, a finishing grindstone 163 that includes a front bevel processing surface for forming a front bevel of a high curve lens and a rear bevel processing surface for forming a rear bevel, a finishing grindstone 164 that includes a V groove for forming a bevel used for a low curve lens and a flat-finishing surface, and a polishing grindstone 165 that includes a V groove for forming a bevel and a flat-finishing surface. The diameter of the roughing grindstone 162 is about 100 mm. The grindstone spindle 161*a* is rotated by a motor 160. These members configure a grindstone rotating unit. As the roughing tool and the finishing tool, a cutter may be used.

The lens chuck shaft 102R is moved to the lens chuck shaft 102L side by a motor 110 provided in a right arm 101R of the carriage 101. The lens chuck shafts 102R and 102L are rotated in synchronization by a motor 120 provided in a left arm 101L via a rotation transmission mechanism such as a gear or the like. An encoder 121 that detects the rotation angle of the lens chuck shafts 102L and 102R is provided on the rotation shaft of the motor 120. Load torque applied to the lens chuck shafts 102R and 102L during processing is detected through the encoder 121. These members configure a lens rotating unit.

The carriage 101 is mounted on a base 140 that can move along shafts 103 and 104 extending in the X-axis direction, and is moved in the X-axis direction (axial direction of the chuck shaft) through driving of a motor 145. An encoder 146 that detects the movement position of the carriage 101 (that is, the chuck shafts 102R and 102L) in the X-axis direction is provided on the rotation shaft of the motor 145. These configure an X-axis direction movement unit. Shafts 156 and 157 that extend in the Y-axis direction (direction in which the axis-to-axis distance between the chuck shafts 102L and 102R and the grindstone spindle 161*a* changes) are fixed to the base 140. The carriage 101 is mounted on the base 140 so as to be movable in the Y-axis direction along the shafts 156 and 157. A motor 150 for Y-axis movement is fixed to the base 140. The rotation of the motor 150 is transmitted to a ball screw 155 that extends in the Y-axis direction, and the carriage 101 is moved in the Y-axis direction through the rotation of the ball screw 155. An encoder 158 that detects the movement position of the chuck shaft in the Y-axis direction is provided on the rotation shaft of the motor 150. These members configure a Y-axis direction movement unit (axis-to-axis distance changing unit).

Figure 2:
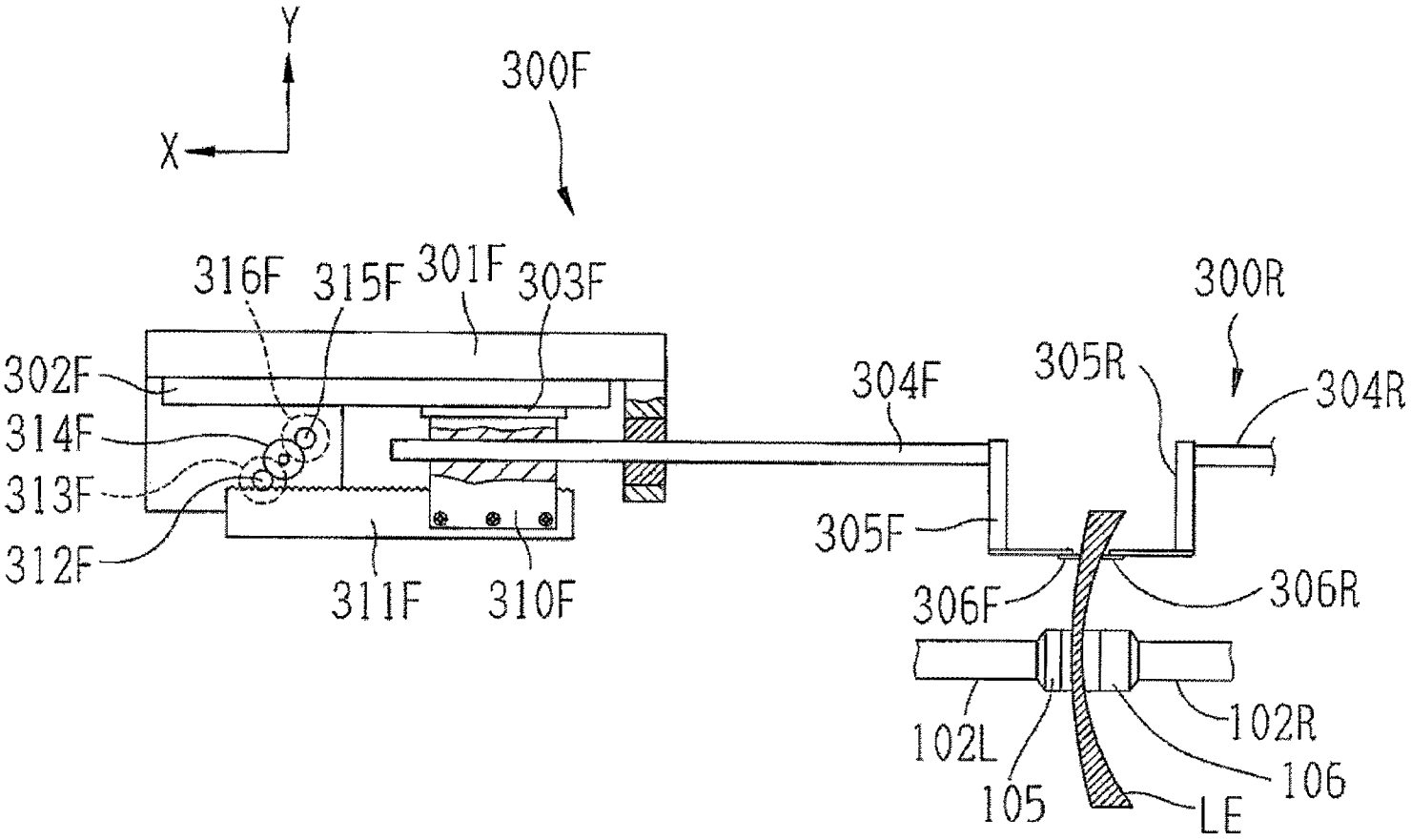
FIG. 2 is a configuration view of lens edge position detection units.

In FIG. 1, lens edge position detection units 300F and 300R as lens surface shape measurement units are provided in the left and right sides above the carriage 101. FIG. 2 is a schematic configuration view of the detection unit 300F that detects the edge position of the front surface of the lens (edge position of the front surface side of the lens of a target lens shape).

A base 301F is fixed to a block 300*a* that is fixed to the base 170. A tracing stylus arm 304F is held in the base 301F via a slide base 310F so as to be able to slide in the X-axis direction. An L-shaped hand 305F is fixed to the leading end portion of the tracing stylus arm 304F, and a tracing stylus 306F is fixed to the leading end of the hand 305F. The tracing stylus 306F contacts the front surface of the lens LE. A rack 311F is fixed to the lower end portion of the slide base 310F. The rack 311F is engaged with a pinion 312F of an encoder 313F which is fixed to the base 301F side. The rotation of a motor 316F is transmitted to the rack 311F via a rotation transmission mechanism such as gears 315F and 314F, whereby the slide base 310F is moved in the X-axis direction. The tracing stylus 306F provided in a retreating position is moved to the lens LE side by driving of the motor 316F, and pressure for measurement pressing the tracing stylus 306F on the lens LE is applied. During the detection of the front surface position of the lens LE, the lens chuck shafts 102L and 102R are moved in the Y-axis direction while the lens LE is rotated based on the target lens shape, and the edge position (edge position of the front surface side of the lens of the target lens shape) of the front surface of the lens in the X-axis direction is detected by the encoder 313F.

The configuration of the detection unit 300R for detecting the edge position of the rear surface of the lens is bilaterally symmetric to the detection unit 300F. Accordingly, the "F" at the end of reference numerals applied to respective elements of the detection unit 300F shown in FIG. 2 is switched to an "R", whereby the descriptions thereof are omitted.

In FIG. 1, a chamfering unit 200 is disposed at the front side of the body of the apparatus, and a drilling and grooving unit 400 is disposed at the rear of a carriage portion 100. Since known configurations are used for these configurations, detailed descriptions thereof will be omitted.

Figure 3A:
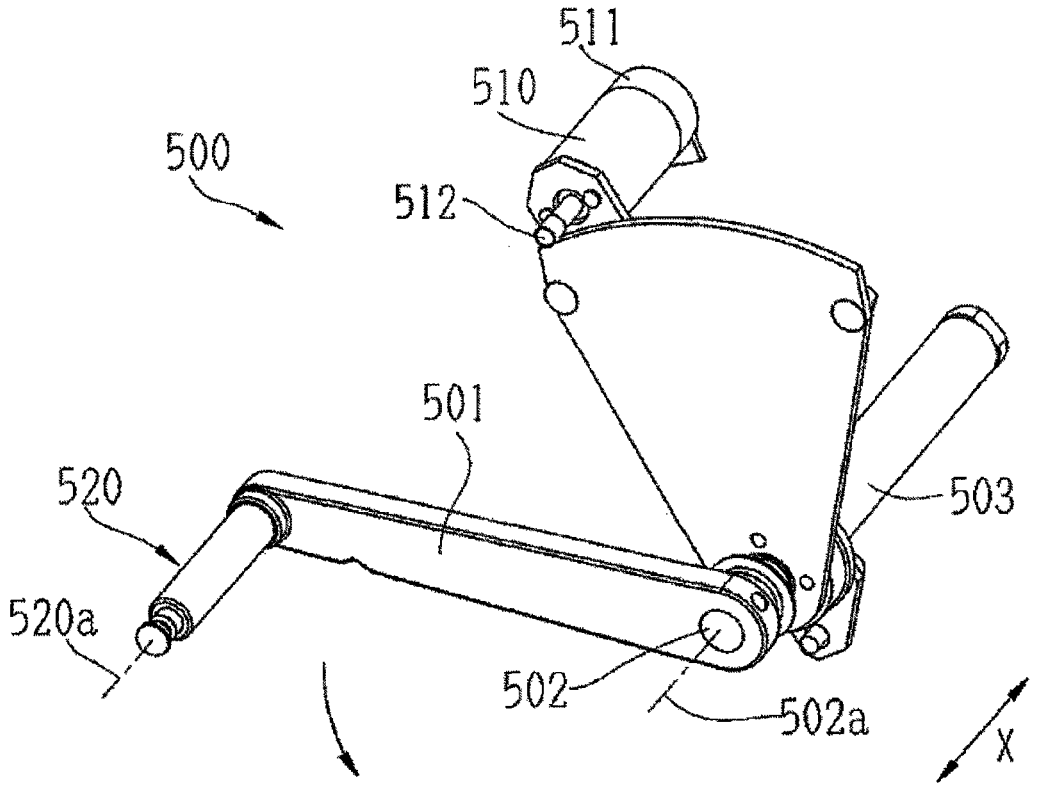
FIG. 3A is a schematic configuration view of a lens outside diameter detection unit.
Figure 3B:
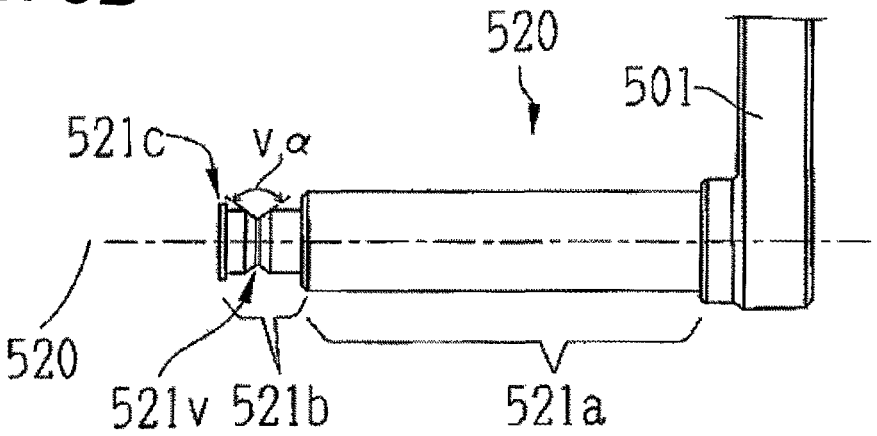
FIG. 3B is a front view of a tracing stylus.

In FIG. 1, behind and above the lens chuck shaft 102R side, a lens outside diameter detection unit 500 is disposed. FIG. 3A is a schematic configuration view of the lens outside diameter detection unit 500. FIG. 3B is a front view of a tracing stylus 520 included in the unit 500.

The cylindrical tracing stylus 520 that is brought into contact with the edge of the lens LE is fixed to one end of an arm 501, and to the other end of the arm 501, a rotation shaft 502 is fixed. A central axis 520*a* of the tracing stylus 520 and a central axis 502*a* of the rotation shaft 502 are arranged in a positional relationship in which the central axes are parallel to the lens chuck shafts 102L and 102R (X-axis direction). The rotation shaft 502 is held in a holding portion 503 so as to be rotatable on the central axis 502*a*. The holding portion 503 is fixed to the block 300*a* in FIG. 1. A fan-like gear 505 is fixed to the rotation shaft 502, and the gear 505 is rotated by the motor 510. A pinion gear 512 that is engaged with the gear 505 is provided θn the rotation shaft of the motor 510. In addition, on the rotation shaft of the motor 510, an encoder 511 as a detector is provided.

The tracing stylus 520 includes a cylindrical portion 521*a* that contacts the lens LE when the outside diameter of the lens LE is measured, a cylindrical portion 521*b* with a small diameter that includes a V groove 521*v* used when the position in the X-axis direction of the bevel formed in the lens LE is measured, and a projection portion 521*c* used when the groove position formed in the lens is measured. An opening angle vα of the V groove 521*v* is so formed such that the angle vα is equal to or wider than the opening angle of the V groove for forming a bevel that the finishing grindstone 164 has. A depth vd of the V groove 521*v* is so formed such that the depth vd is shallower than a V groove of the finishing grindstone 164. As a result, the bevel formed in the lens LE by the V groove of the finishing grindstone 164 is inserted in the center of the V groove 521*v* without interfering with other portions.

Figure 4:
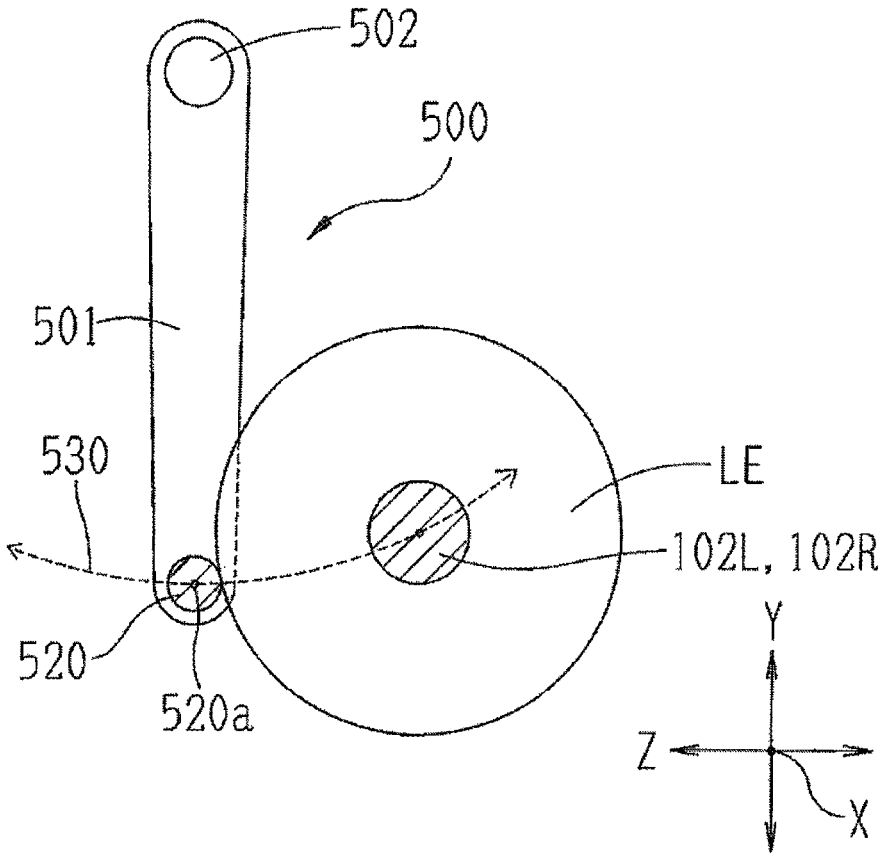
FIG. 4 is a view illustrating the measurement of the outside diameter of a lens performed by the lens outside diameter detection units.

The lens outside diameter detection unit 500 is used for detecting whether or not the outside diameter of the unprocessed lens LE is large enough for the target lens shape, when the periphery of a normal eyeglass lens LE is processed. When the outside diameter of the lens LE is measured, the lens chuck shafts 102L and 102R are moved to a predetermined measurement position (on the movement path 530 of the central axis 520*a* of the tracing stylus 520 that rotates on the rotation shaft 502), as shown in FIG. 4. When the arm 501 is rotated by the motor 510 in a direction (Z-axis direction) orthogonal to the X-axis and Y-axis of the processing apparatus 1, the tracing stylus 520 that has been placed in the retreating position is moved to the lens LE side, and the cylindrical portion 521*a* of the tracing stylus 520 contacts the edge (periphery) of the lens LE. In addition, a predetermined pressure for measurement is applied to the tracing stylus 520 by the motor 510. The lens LE is rotated for each fine angle step, and the movement of the tracing stylus 520 at this time is detected by the encoder 511, whereby the outside diameter size of the lens LE based on the chuck center is measured.

As the lens outside diameter detection unit 500, in addition to the configuration including the rotation mechanism of the arm 501 described above, a mechanism which is moved linearly in a direction (Z-axis direction) orthogonal to the X-axis and Y-axis of the processing apparatus 1 may be used. Moreover, the lens edge position detection unit 300F (or 300R) as the lens surface shape measurement unit can also be used as the lens outside diameter detection unit. In this case, while the tracing stylus 306F abuts on the front surface of the lens, the lens chuck shafts 102L and 102R are moved in the Y-axis direction so that the tracing stylus 306F moves to the outside diameter side of the lens. When the tracing stylus 306F reaches the outside diameter of the lens, values detected by the encoder 313F are sharply changed. Accordingly, it is possible to detect the outside diameter of the lens from the movement distance in the Y-axis direction at this time.

Figure 5:
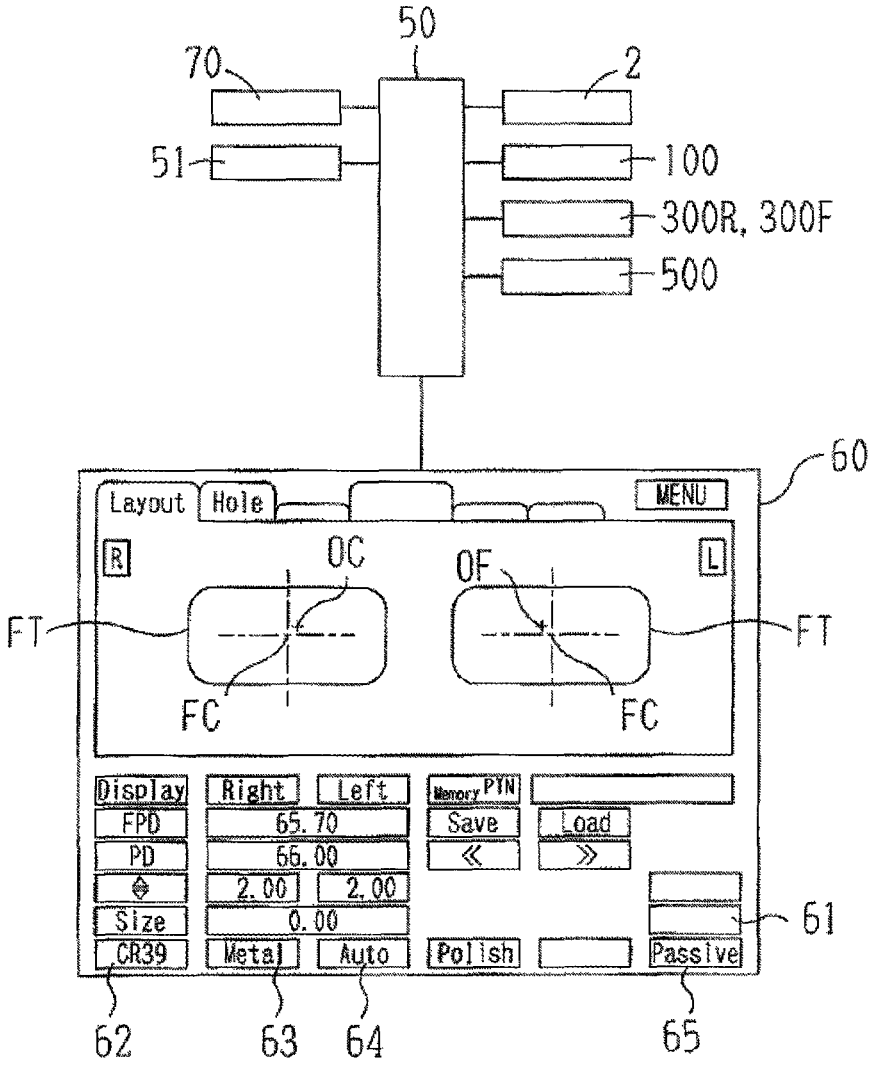
FIG. 5 is a control block diagram of the eyeglass lens processing apparatus.

FIG. 5 is a control block diagram of the eyeglass lens processing apparatus. A control unit 50 controls the entire apparatus overall, and performs calculation processing based on various types of measurement results and input data. The respective motors, the lens edge position detection units 300F and 300R, and the lens outside diameter detection unit 500, which are shown in FIG. 1, are connected to the control unit 50. In addition, to the control unit 50, a display 60 that has a touch panel function for inputting processing condition data, a switch portion 70 provided with a processing start switch and the like, a memory 51, an eyeglass frame shape measurement device 2, and the like are connected. In the memory 51, lens processing programs (processing sequences), a program that determines (estimates) a lens thickness based on the edge position of the front and rear surfaces of the lens and the outside diameter of the lens, and the like are stored. The processing program varies with the material of the lens, and selected by the control unit 50 based on the setting of the processing condition or the like so as to be executed.

Next, the operations of the apparatus will be described. There are 2 types of resinous materials used as the eyeglass lens. Examples of a lens of a thermosetting resin that exhibits an increase in hardness (that is hardened) when heat is applied thereto during processing include a general plastic lens, a high-refraction plastic lens, and the like. Examples of a lens of a thermoplastic resin that is softened when heat is applied thereto during the processing include a lens of polycarbonate, acryl, Trivex, and the like. During the roughing of the thermosetting resin, in order to prevent a temperature increase at a processing site caused by the friction between the grindstone and the lens, grinding water (cooling water) is supplied to the processing site. During the roughing of the thermoplastic resin, heat generated by the friction between the grindstone and the lens is used so that the processing is performed while the processing site is maintained at a high temperature. If the grinding water is supplied, the processing waste attaches to the cooled grindstone and the lens, which is not preferable. Accordingly, the grinding water is not supplied for the thermoplastic resin. The characteristics of the materials are disclosed in U.S. Pat. No. 7,617,579B1 which is incorporated herein by reference.

Hereinafter, description will be made focusing mainly on processing operations of a polycarbonate lens which is a thermoplastic lens.

First, the control unit 50 obtains a target lens shape data. The target lens shape data of a lens frame obtained by the measurement of the eyeglass frame shape measurement device 2 is input when the switch included in the switch portion 70 is pressed, and stored in the memory 51. The display 60 displays a target lens shape figure FT based on the input target lens shape data. A layout data including the pupillary distance (PD value) of a wearer, the inter-center distance between frames of a eyeglass frame F (FPD value), and the height of an optical center OC with respect to the geometric center FC of the target lens shape, and the like is ready to be input. The layout data is input by the operation of a predetermined touch key. When the layout data is input, the input target lens shape data is converted into a new target lens shape data (rn, θn) (n=1, 2, 3, . . . , N) by the control unit 50 based on the geometric center FC. rn is the length of a radius vector of the target lens shape, and θn is the angle of a radius vector of the target lens shape. N is 1000 points, for example.

The material of the lens is selected by a touch key (switch) 62. As the material of the lens, a general plastic lens, a high-refraction plastic lens, a polycarbonate lens, and the like can be selected. The type of a frame is selected by a touch key 63. A processing mode (a bevel processing mode, a flat-processing mode) is selected by a touch key 64.

Prior to the processing of the lens LE, an operator fixes a cup Cu which is a fixing jig to the front surface of the lens LE by using a well-known blocker. At this time, there are an optical center mode in which the cup is fixed to the optical center OC of the lens LE and a frame center mode in which the cup is fixed to the geometric center FC of the target lens shape. It is possible to select either the optical center mode or the frame center mode by using a touch key 65. In the optical center mode, the optical center OC of the lens LE is chucked by the lens chuck shafts (102L and 102R) and becomes the rotation center of the lens. In the frame center mode, the geometric center FC of the target lens shape is chucked by the lens chuck shafts, and becomes the rotation center of the lens.

The surface of the lens treated with a water repellent coating (water repellent lens) is slippery, and "axial deviation" easily occurs in the water repellent lens during roughing. It is possible to select either a soft processing mode (a first mode) used for processing the water repellent lens or a normal processing mode (a second mode) used for processing a lens that has not been treated with the water repellent coating by using a touch key (switch) 61. Hereinafter, a case of the polycarbonate lens treated with the water repellent coating will be described for example. In this case, the polycarbonate lens is selected as the material of the lens by the touch key 62 which is a material selector for selecting material of the lens, and the soft processing mode is selected by the touch key 61 which is a processing mode selector.

The operator inserts the cup Cu fixed to the lens LE in a cup holder provided at the leading end side of the lens chuck shaft 102L. Thereafter, when the lens chuck shaft 102R is moved to the lens LE side by driving of the motor 110, the lens LE is held in the lens chuck shaft 102R. When the start switch in the switch portion 70 is pressed after the lens LE is held by the lens chuck shaft 102R, the lens edge position detection units 300F and 300R and the lens outside diameter detection unit 500 are operated by the control unit 50, whereby the curve shape of the front and rear surfaces of the lens and the outside diameter of the lens are measured.

In obtaining the outside diameter data of the lens, if the apparatus does not include the lens outside diameter detection unit 500, the apparatus may have a configuration in which the outside diameter data of the lens measured by a caliper or the like is input by a switch provided in the display 60. In addition, in obtaining the curve shape of the front and rear surfaces of the lens, a configuration in which the curve shape data of the front and rear surfaces of the lens which is separately measured is input by a switch provided in the display 60 may be employed.

Figure 6:
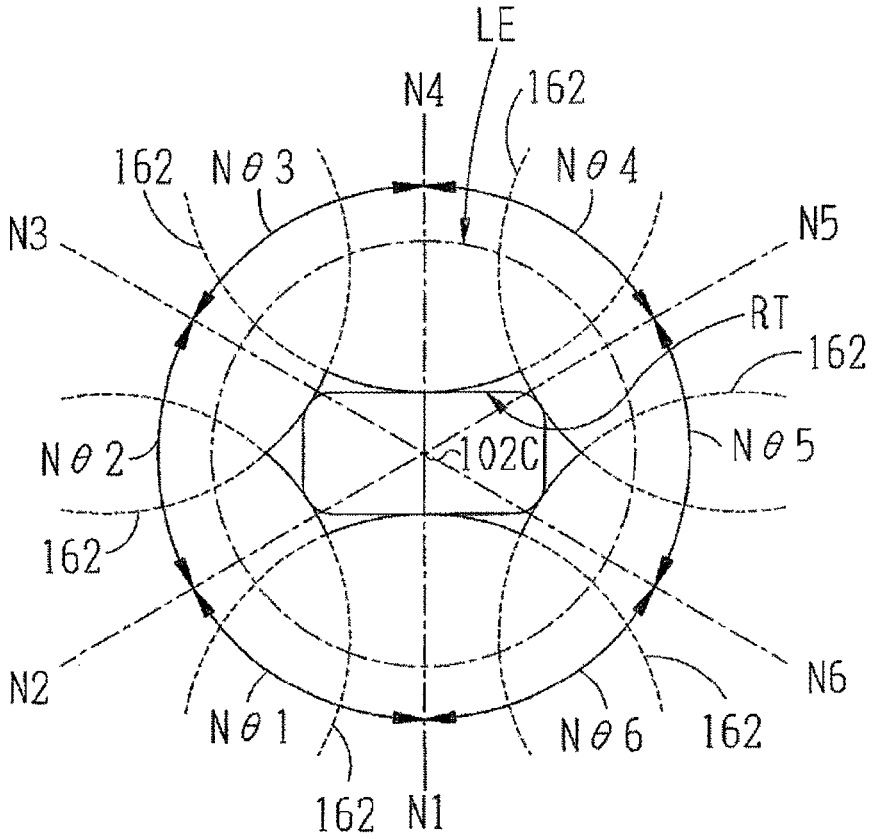
FIG. 6 is a view illustrating a first step of roughing.

If measuring the curve shape of the front and rear surfaces of the lens and the outside diameter of the lens is completed, the processing moves to a step of roughing. Hereinafter, roughing operations that suppress the "axial deviation" will be described. FIG. 6 is a schematic view illustrating the roughing operations. Hereinafter, in order to simplify the description, the chuck center (rotation center) 102C of the lens is taken as the optical center OC.

The control unit 50 calculates a roughing path RT processed by the roughing grindstone 162 based on the input target lens shape data. The roughing path RT is calculated by adding the target lens shape to a lens margin (for example, 2 mm) allowed for finishing. The control unit 50 functions as a calculating unit for calculating the roughing path RT. As a first step of roughing, the control unit 50 causes the roughing grindstone 162 to cut into the lens LE up to the roughing path RT (which also includes the vicinity of the roughing path RT) in a plurality of lens rotation angle directions Ni (i=1, 2, 3, . . . ) without rotating the lens (while stopping the rotation of the lens). That is, the lens rotation angle direction Ni (plural lens rotation angles) becomes a direction in which the roughing grindstone 162 cuts into the lens LE while the lens LE does not rotate. FIG. 6 shows an example in which the roughing grindstone 162 cuts into the lens LE in 6 directions of N1, N2, N3, N4, N5, and N6 as the plurality of lens rotation angle directions Ni. Each of angles Nθ1, Nθ2, Nθ3, Nθ4, Nθ5, and Nθ6 (interval of adjacent angles), which is an angle between 2 directions among the directions N1 to N6, is equally divided into 60°. In practice, the rotation center of the roughing grindstone 162 is fixed, and the lens LE rotates. However, in FIG. 6, the center of the roughing grindstone 162 is shown to be positioned in each direction of N1 to N6 around the chuck center 102C of the lens LE, in a relative sense. After the first step of roughing, as a second step of roughing, the control unit 50 controls the movement of the lens chuck shafts 102R and 102L in the Y-axis direction along the roughing path RT while rotating the lens LE (the control unit 50 controls the axis-to-axis distance changing unit), thereby roughing a processing region RB that remains after the first step of roughing. The rotation direction of the lens LE in the second step is set by the up-cut method in which the rotation direction of the roughing grindstone 162 becomes the same as the rotation direction of the lens LE.

Figure 7:
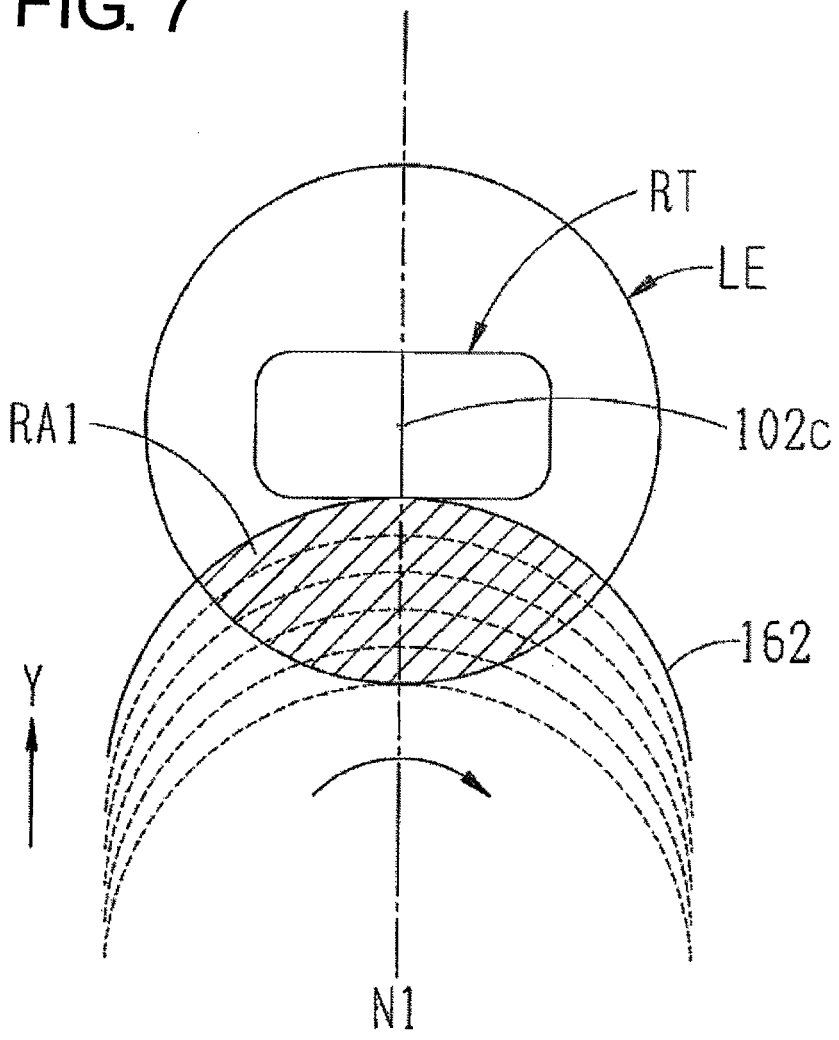
FIG. 7 is a view illustrating a case where a roughing grindstone cuts into the lens in an N1 direction.
Figure 8:
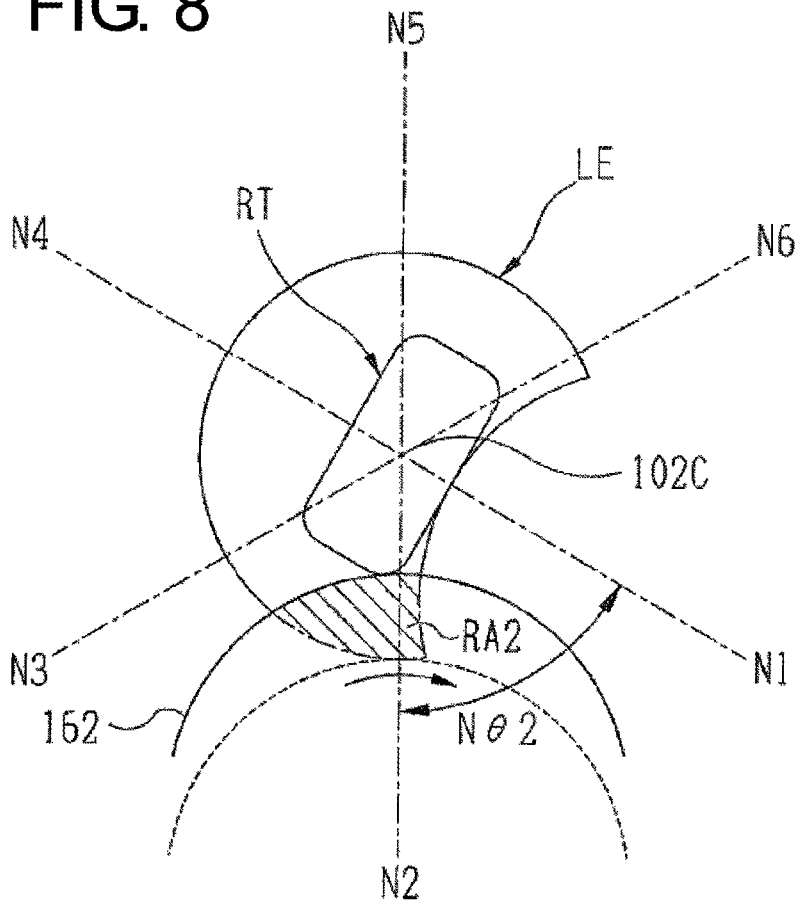
FIG. 8 is a view illustrating a case where the roughing grindstone cuts into the lens in an N2 direction.
Figure 9:
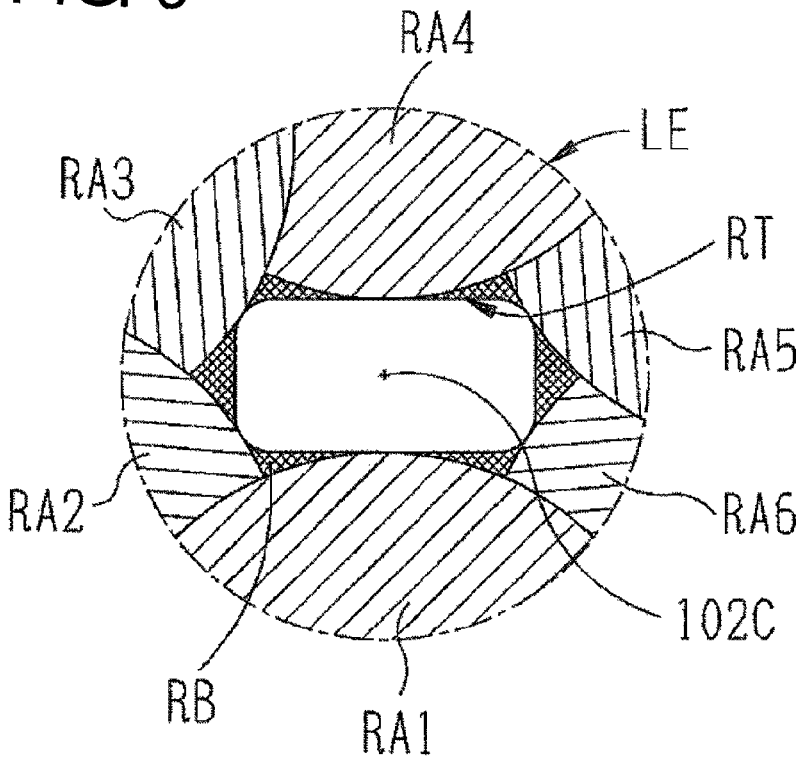
FIG. 9 is a view illustrating a region roughed in the first step of roughing and a region roughed in a second step of roughing.

The first step of roughing will be described in detail. First, the control unit 50 sets the N1 direction to the Y-axis direction, moves the lens chuck shafts 102L and 102R without rotating the lens LE (controls the drive of the motor 150 of the axis-to-axis distance changing unit), and controls the roughing grindstone 162 to cut into the lens LE until the roughing grindstone 162 reaches the roughing path RT. FIG. 7 is a view illustrating a state where the roughing grindstone 162 cuts into the lens LE in the N1 direction, and a region RA1 is a portion chipped away while the lens LE does not rotate. Thereafter, the control unit 50 controls the drive of the axis-to-axis distance changing unit (motor 150) so as to move the lens chuck shafts 102L and 102R so as to separate the lens LE from the roughing grindstone 162, and then drives the motor 120, thereby rotating the lens LE by the angle Nθ1 (60°) so as to set the next rotation direction (rotation angle). As a result, the N2 direction and the Y-axis direction coincide with each other, as shown in FIG. 8. Subsequently, the control unit 50 again controls the axis-to-axis distance changing unit (motor 150) so as to move the lens LE to the grindstone 162 side without rotating the lens LE, thereby causing the roughing grindstone 162 to cut into the lens LE up to the roughing path RT. The portion chipped away at this time is a region RA2 indicated by diagonal lines in FIG. 8. Thereafter, by the repetition of the same operations in each of the N3, N4, N5, and N6 directions which corresponds to one revolution of the lens LE, regions RA3, RA4, RA5, and RA6 are sequentially chipped away as shown in FIG. 9. In FIG. 9, the region RB remaining outside the roughing path RT is a portion to be processed in the second step.

When separating the lens LE from the roughing grindstone 162, the control unit 50 may not keep stopping the rotation of the lens LE, but may start rotating the lens LE to a degree in which the lens LE is processed to some extent, so as to set the lens LE to the next rotation angle. In this manner, it is possible to shorten the processing time.

In the processing sequence of the first step, the lens LE does not rotate while being roughed. Therefore, a rotational load (load torque) applied to the lens LE is small, and the occurrence of the "axial deviation" is suppressed. The reason is as follows. Through the rotation of the roughing grindstone 162, the rotational load applied to the lens LE is influenced by the frictional force generated between the lens LE and the roughing grindstone 162 (a frictional force generated along the rotation direction of the roughing grindstone 162). If the lens LE is roughed by the roughing grindstone 162 while being rotated, the torque of the chuck shafts 102L and 102R is further applied, and a force acts pulling the lens LE to the roughing grindstone 162 side which is in the rotation direction of the lens LE. Consequently, a load which further rotates the lens LE increases, and this causes the "axial deviation". Contrary to this, when the lens LE is not rotated, a force pressing the lens LE in the Y-axis direction in which the center of the roughing grindstone 162 is positioned acts greatly on the lens LE, and the frictional force caused by the rotation of the roughing grindstone 162 is also offset by a reactive force of the pressing force, whereby the rotational load that attempts to rotate the lens LE is almost not generated. As a result, when the lens LE is not rotated, the occurrence of the "axial deviation" is suppressed. Therefore, in the first step of roughing, only the load in the Y-axis direction may be considered.

In order not to cause the load in the Y-axis direction to exceed a certain value, the movement speed in the Y-axis direction is simply set to equal to or lower than a predetermined allowable value. The load in the Y-axis direction relates to a processing amount per unit time. Accordingly, preferably, by setting the processing amount per unit time to equal to or smaller than a certain value, it is possible to reduce the load in the Y-axis direction and to suppress the deviation in the Y-axis direction. The processing amount per unit movement distance in the Y-axis direction is determined based on the outside diameter of the lens which is measured and input (as the outside diameter, a fixed value, such as 70 mm diameter may be simply employed), the shape of the front and rear surfaces of the lens, the lens thickness, the roughing path RT, and the radius of the roughing grindstone 162, and the movement speed of the lens LE in the Y-axis direction is controlled so that the processing amount becomes equal to or smaller than a certain value with respect to the unit time. As a result, the positional deviation of the lens LE in the Y-axis direction does not occur.

Even if the processing waste that is discharged in the rotation direction of the roughing grindstone 162 in the first step melts due to the heat, the processing waste is discharged in the direction in which the region RB (see FIG. 9) outside the roughing path RT is tapered. Accordingly, it is difficult for the processing waste to be attached to the lens LE, similarly to the up-cut method.

The second step of roughing will be described. After the completion of the first step of roughing, while rotating the lens LE by the drive of the motor 120, the control unit 50 controls the movement of the lens chuck shafts 102R and 102L in the Y-axis direction so that the roughing grindstone 162 moves along the roughing path RT (the control unit 50 controls the drive of the motor 150 of the axis-to-axis distance changing unit). Whenever the lens rotates once (alternatively, the lens rotates plural times depending on the processing amount in some cases), the processing region RB shown in FIG. 9 is chipped away. The rotation direction of the lens LE is set by the up-cut method. Since the most of the periphery of the lens LE is chipped away by the first step of roughing, the protruding amount of the processing region RB from the roughing path RT has been reduced (the distance from the chuck center 102C has been shortened). Moreover, since the processing amount (remaining amount) of the region RB has been reduced, an area in which the roughing grindstone 162 contacts the lens LE is small. Accordingly, the frictional force that the lens LE receives from the roughing grindstone 162 is also reduced, hence the force (load torque) in the rotation direction received from the roughing grindstone 162 is reduced. Consequently, even if the roughing for removing the region RB is performed while the lens LE is rotated, the rotational load applied to the lens LE is small. As a result, the occurrence of the axial deviation is suppressed.

The rotation speed of the lens LE in the second step is set to equal to or lower than a certain value which is so set such that the "axial deviation" does not occur. It is preferable to control the rotation speed of the lens LE so that the processing amount per unit time becomes equal to or smaller than a certain value. It is possible to control the rotation speed by determining the processing amount per unit rotation angle of the lens, based on the outside diameter yielded after the first step of roughing, the shape of the front and rear surfaces of the lens, the lens thickness, the roughing path RT, and the radius of the roughing grindstone 162.

Although the above processing control has been described as the processing control applied to the roughing of the polycarbonate lens treated with a water repellent coating, the processing control may be also applied to a case of a polycarbonate lens that has not been treated with a water repellent coating (a case where the normal processing mode is selected). In the case of the polycarbonate lens that has not been treated with the water repellent coating, the movement speed of the Y-axis in the first step and the rotation speed of the lens in the second step are set to be a higher speed respectively, compared to the polycarbonate lens that has been treated with the water repellent coating. As a result, in the case of the polycarbonate lens that has not been treated with a water repellent coating, the roughing time is shortened.

After the completion of the roughing, the periphery of the lens LE is subjected to finishing by the finishing grindstone 164 based on finishing data calculated based on the target lens shape. Although the finishing includes bevel-finishing, flat-processing, and the like, description thereof will be omitted since a known method is applied to the control of the finishing.

Figure 10:
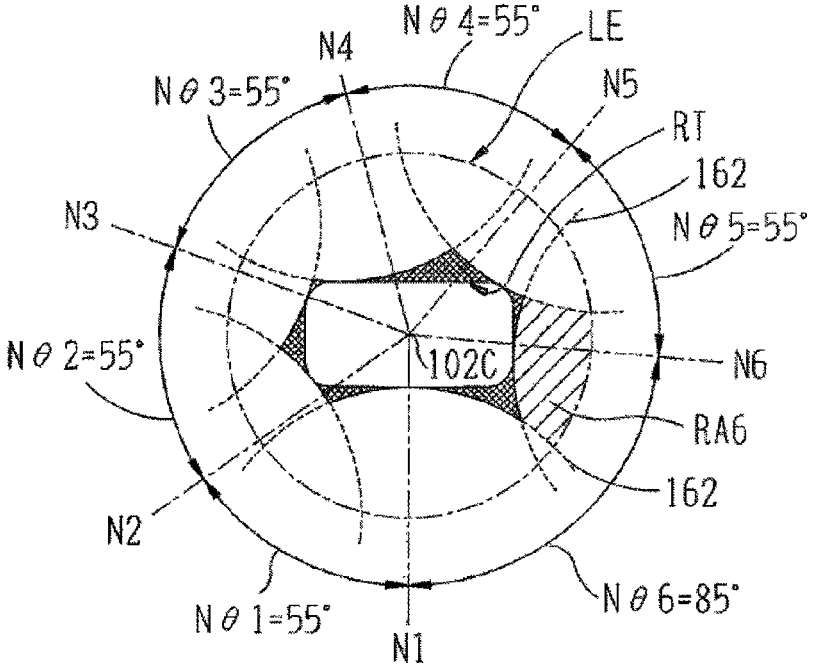
FIG. 10 is a view illustrating a modified example of the first step of roughing.

In the embodiment described above, the angles Nθ1 to Nθ6 of N1 to N6 in the first step of roughing are equally divided into 60° respectively. However, the invention is not limited thereto. If the region RA6 (see FIG. 9) that is processed when the processing sequence comes to the last N6 direction becomes too small, the lens might be broken when this region is cut. In order to prevent this, the angle Nθ6 between the first N1 direction and the last N6 direction is set to be larger than the angles of other portions. For example, as shown in FIG. 10, if the angles Nθ1 to Nθ5 are set to 55° respectively, the angle Nθ6 becomes 85°. If the N1 direction is taken as a base, N2=55°, N3=110°, N4=165°, N5=220°, and N6=275°. As a result, the region RA6 does not become too small, and it is possible to prevent the lens LE (the portion of the region RA6) from being broken when the lens LE is cut in the N6 direction.

The number of the plurality of the lens rotation angle directions Ni (N1, N2, N3, . . . ) and the angles Nθi (Nθ1, Nθ2, Nθ3, . . . ) shown in FIGS. 6 and 10 are merely examples, and the invention is not limited thereto. The angles Nθi are not necessarily the same as each other. The diameter of the roughing grindstone 162 which is a roughing tool is about 100 mm in the apparatus of the embodiment. However, in practice, one with a diameter of 60 to 120 mm is used as the roughing grindstone 162, and if this type of roughing grindstone 162 is used, the angle Nθi is preferably 30° to 80° (except for the angle between the first N1 direction and the last direction). If the angle Nθi is smaller than 30°, the tapered portion of the region RA that protrudes outside the roughing path RT becomes too small, which causes the processing waste discharged in the rotation direction of the roughing grindstone 162 to be easily attached to the lens LE. If the angle Nθi is set to 30° uniformly, the number of times of cutting in the rotation angle direction Ni increases, so the processing time is lengthened. If the angle Nθi is larger than 80°, a large number of portions distant from the chuck center 102C easily remains as the region RB which remains after the first step of roughing, and the unprocessed periphery of the lens remains easily as it is. Moreover, the processing amount in the second step of roughing increases. In practice, the angle Nθi is preferably 40° to 72°.

In practice, the number of rotation angle directions Ni which are the cutting directions is preferably 5 to 12. That is, the plurality of lens rotation angles (Ni), each of which is an angle between 3 directions among the adjacent directions, are angles obtained by dividing one rotation (360 degrees) of the lens by 5 to 12. If the number of directions Ni is 4 or less, a large number of portions appears in which the periphery of the unprocessed lens remains as is, and the "axial deviation" easily occurs in the second step of roughing. When the angle Nθi is set to 72° uniformly, the number of the direction Ni becomes 5. If the number of directions Ni is larger than 12, the processing waste discharged in the rotation direction of the roughing grindstone 162 is easily attached to the lens LE, similarly to the case where the angle Nθi is smaller than 30°.

The respective directions Ni (that is, respective angle Nθi) are preset according to the diameter of the roughing grindstone 162, and stored in the memory 51. Alternatively, a configuration may be used in which the respective directions Ni (the respective angle Nθi) are set by the control unit 50 for each processing of the lens LE based on the diameter of the roughing grindstone 162, the roughing path RT (or target lens shape), and the outside diameter of the unprocessed lens (lens before processing), so that the periphery of the unprocessed lens does not remain after the first step of processing (or, so that the distance between the chuck center 102C and the region RB becomes a certain distance or less). In the case that a distance between the region RB and the center 102C is equal to or less than a predetermined distance, the predetermined distance is smaller than a radius of the unprocessed lens and is a distance at which the axial deviation does not occur at the second step (for example, 25 mm). Incidentally, the outside diameter of the unprocessed lens may be input or measured by the lens outside diameter detection unit 500 in advance, or may be stored in the memory 51 as the fixed value such as 70 mm diameter.

In the above description, a case where the touch key (material selector) 62 selects the thermoplastic material is explained. If the touch key 62 selects a thermoset material (plastic, etc.), the control unit 50 does not perform the first step of the roughing, and performs, from the beginning, the second step of the roughing in which the control unit controls the axis-to-axis direction changing unit so as to cause the roughing grindstone 162 to cut into the lens up to the roughing path while rotating the lens.

Further, even if the touch key 62 selects the thermoset material, the control unit may perform both the first and second steps of the roughing to reduce the axial deviation, Incidentally, if the thermoset material is selected, in the second step of the roughing, the control unit 30 controls the lens rotating unit (motor 120) to rotate the lens in a direction opposite to a rotating direction of the roughing tool.

As described above, the invention can be modified in various manners, and modifications are also included in the invention within the technical scope of the invention.

What is claimed is:

1. An eyeglass lens processing apparatus comprising:

a lens rotating unit including a lens chuck shaft for holding an eyeglass lens and a motor for rotating the lens chuck shaft;

only one processing tool rotating unit including a roughing tool for roughing a periphery of the lens, a processing tool rotating shaft to which the roughing tool is attached, and a motor for rotating the processing tool rotating shaft;

an axis-to-axis distance changing unit including a motor moving the lens chuck shaft toward the processing tool rotating shaft to change an axis-to-axis distance between the lens chuck shaft and the processing tool rotating shaft;

a control unit obtaining a roughing path based on a target lens shape, and controlling the lens rotating unit and the axis-to-axis distance changing unit based on the obtained roughing path to rough the periphery of the lens by the roughing tool, wherein the control unit performs a first step and then a second step, wherein in the first step, the control unit executes a cut-in processing operation a plurality of times, wherein in each of the cut-in processing operations, the control unit controls the axis-to-axis distance changing unit to cause the roughing tool to cut into the lens up to the roughing path, controls the axis-to-axis distance changing unit to separate the roughing tool from the lens after the roughing tool is cut into the lens up to the roughing path and controls the lens rotating unit to rotate the lens by a lens rotation angle, the lens being not rotated by the lens rotating unit when the roughing tool is cutting into the lens up to the roughing path, wherein in the second step, the control unit controls the lens rotating unit and the axis-to-axis distance changing unit to rough the lens based on the roughing path while the lens rotating unit rotates the lens, and wherein the roughing tool cuts into the lens along an entire thickness direction of the lens in both the first step and the second step, wherein the thickness direction is perpendicular to a movement direction of the lens chuck shaft.

2. The eyeglass lens processing apparatus according to claim 1, wherein in the first step, after the roughing tool cuts into the lens up to the roughing path while not rotating the lens, the control unit controls the axis-to-axis distance changing unit to separate the lens from the roughing tool, controls the lens rotating unit to rotate the lens by a predetermined angle, controls the axis-to-axis distance changing unit to cause the roughing tool to cut into the lens up to the roughing path again while not rotating the lens, and repeats these processes in the plurality of lens rotation angle directions until the lens rotates once under these processes.

3. The eyeglass lens processing apparatus according to claim 2, wherein the predetermined angle is set within a range from 30 degrees to 80 degrees.

4. The eyeglass lens processing apparatus according to claim 3, wherein the plurality of lens rotation angles are angles obtained by dividing one rotation of the angle by 5 to 12.

5. The eyeglass lens processing apparatus according to claim 3, wherein the plurality of rotating angles are stored in a memory as predetermined values.

6. The eyeglass lens processing apparatus according to claim 3, wherein the control unit sets the plurality of rotating angles based on a diameter of the roughing tool, the roughing path or a target lens shape, and a diameter of the unprocessed lens.

7. The eyeglass lens processing apparatus according to claim 6, wherein the control unit sets the plurality of rotating angles so that the entire periphery of the lens is processed by the roughing tool at the first step.

8. The eyeglass lens processing apparatus according to claim 6, wherein the control unit sets the plurality of rotating angles so that a distance between a chuck center of the lens chuck shaft and a roughing region where the roughing tool roughs the lens in the first step is equal to or less than a predetermined distance which is smaller than a radius of the lens and at which an axial deviation between the lens and the lens chuck shaft does not occur at the second step.

9. The eyeglass lens processing apparatus according to claim 6, wherein the plurality of lens rotation angles are angles obtained by dividing one rotation of the angle by 5 to 12, and an interval of the adjacent angles are within a range between 30 degrees and 80 degrees.

10. The eyeglass lens processing apparatus according to claim 1 further comprising a material selector selecting material of the lens, wherein if the material selector selects a thermoplastic material for the lens, the control unit performs the first step and then the second step, wherein in the second step of roughing, the control units controls the lens rotating unit to rotate the lens in the same direction as the rotation direction of the roughing tool.

11. The eyeglass lens processing apparatus according to claim 10, wherein if the material selector selects a lens of thermoset material, in the second step, the control unit controls the lens rotating unit to rotate the lens in a direction opposite to a rotating direction of the roughing tool.

12. The eyeglass lens processing apparatus according to claim 1, wherein the control unit controls the axis-to-axis distance changing unit so that a cutting-in speed of the roughing tool at the first step is set to equal to or less than a predetermined allowable value.

13. The eyeglass lens processing apparatus according to claim 1 further comprising a processing mode selector selecting a first mode in which a surface of the lens is slippery and a second mode in which the surface of the lens is normal, wherein the control unit controls the axis-to-axis distance changing unit so that the cutting-in speed of the roughing tool at the first step in the second mode is faster than that of the first mode, and controls the lens rotating unit so that the rotating speed of the lens at the second step in the second mode is higher than that of the first mode.

14. The eyeglass lens processing apparatus according to claim 1, wherein the roughing tool includes at least one grindstone.

15. The eyeglass lens processing apparatus according to claim 1, further comprising:

a processing mode selector configured to select a first mode in which a surface of the lens is slippery and a second mode in which the surface of the lens is normal, wherein the control unit controls the axis-to-axis distance changing unit and the lens rotating unit in such a manner that the roughing tool roughs the periphery of the lens while the lens rotating unit stops rotating the lens.

16. The eyeglass lens processing apparatus according to claim 1 further comprising:

a processing mode selector selecting a first mode in which the roughing tool roughs the lens while the lens rotating unit stops rotating the lens and a second mode in which the roughing tool roughs the lens while the lens rotating unit rotates the lens, wherein the control unit controls the axis-to-axis distance changing unit and the lens rotating unit according to one of the first mode and the second mode selected by the processing mode selector.

17. The eyeglass lens processing apparatus according to claim 1, wherein the entirety of the first step is completed before the second step is performed.

18. The eyeglass lens processing apparatus according to claim 1, wherein the roughing tool does not contact the lens when the lens rotating unit rotates the lens from a first position among the plurality of lens rotation angles to a second position among the plurality of lens rotation angles.

19. The eyeglass lens processing apparatus according to claim 1, wherein the lens rotation angle set in the first step is larger than a lens rotations angle when the roughing tool processes the lens along the roughing path in the second tap.

20. An eyeglass lens processing apparatus comprising:

a lens rotating unit including a lens chuck shaft for holding an eyeglass lens and a motor for rotating the lens chuck shaft;

a processing tool rotating unit including a roughing tool for roughing a periphery of the lens, a processing tool rotating shaft, having a fixed rotational axis, to which the roughing tool is attached, and a motor for rotating the processing tool rotating shaft, the roughing tool rotating around the fixed rotational axis;

an axis-to-axis distance changing unit including a motor moving the lens chuck shaft toward the processing tool rotating shaft to change an axis-to-axis distance between the lens chuck shaft and the processing tool rotating shaft;

a control unit obtaining a roughing path based on a target lens shape and controlling the lens rotating unit and the axis-to-axis distance changing unit based on the obtained roughing path to rough the periphery of the lens by the roughing tool, wherein the control unit performs a first step and then a second step, wherein the first step, the control unit executes a cut-in processing operation a plurality of time, wherein in each of the cut-in processing operations, the control unit controls the axis-to-axis distance changing unit to cause the roughing tool to cut into the lens up to the roughing path, controls the axis-to-axis distance changing unit to separate the roughing tool from the lens after the roughing tool is cut into the lens up to the roughing path and controls the lens rotating unit to rotate the lends by a lens rotation angle, the lens being not rotated by the lens rotating unit when the roughing tool is cutting into the lens up to the roughing path, wherein in the second step, the control unit controls the lens rotating unit and the axis-to-axis distance changing unit to rough the lens based on the roughing path while the lens rotating unit rotates the lens, and wherein the roughing tool cuts into the lens along an entire thickness direction of the lens in both the first step and the second step, wherein the thickness direction is perpendicular to a movement direction of the lens chuck shaft.

* * * * *